US008553922B2

(12) United States Patent
Yataka

(10) Patent No.: US 8,553,922 B2
(45) Date of Patent: Oct. 8, 2013

(54) EARPHONE MICROPHONE

(75) Inventor: Koji Yataka, Hamamatsu (JP)

(73) Assignee: Yamaha Corporation, Hamamatsu-Shi, Shizuoka-ken (JP)

( * ) Notice: Subject to any disclaimer, the term of this patent is extended or adjusted under 35 U.S.C. 154(b) by 63 days.

(21) Appl. No.: 13/032,595

(22) Filed: Feb. 22, 2011

(65) Prior Publication Data

US 2011/0206229 A1 Aug. 25, 2011

(30) Foreign Application Priority Data

Feb. 24, 2010 (JP) ..... 2010-039296
Nov. 26, 2010 (JP) ..... 2010-263676

(51) Int. Cl.
*H04R 25/00* (2006.01)

(52) U.S. Cl.
USPC ..... 381/380; 381/313; 381/328

(58) Field of Classification Search
USPC ..... 381/71.11, 71.13, 71.5, 71.6, 72, 74, 381/82, 92, 93, 111, 112, 313, 317, 318
See application file for complete search history.

(56) References Cited

U.S. PATENT DOCUMENTS 5,664,014 A 9/1997 Yamaguchi et al.
6,661,901 B1 * 12/2003 Svean et al. ..... 381/317
2002/0141602 A1 10/2002 Nemirovski
2007/0009122 A1 1/2007 Hamacher
2008/0260180 A1 10/2008 Goldstein et al.
2009/0136059 A1 5/2009 Inoda et al.

FOREIGN PATENT DOCUMENTS

CN 1671245 A 9/2005
GB 2401278 A 11/2004
JP 2007-281916 A 10/2007
WO WO-2004-053839 A1 6/2004
WO WO-2006-012578 A2 2/2006
WO WO-2006-028587 A2 3/2006

OTHER PUBLICATIONS

European Search Report issued for EP Application No. 11 00 1480, dated Aug. 16, 2011.
Chinese Office Action issued for Application No. 201110042783.6, mailing date May 6, 2013.

* cited by examiner

*Primary Examiner* — Brian Ensey
(74) *Attorney, Agent, or Firm* — Dickstein Shapiro LLP

(57) ABSTRACT

An earphone microphone is constituted of a main unit and an insert portion which are united in an L-shape. Two receivers are attached to the external surface of the main unit and exposed externally of a user's ear, while one receiver is attached to a distal end of the insert portion that is inserted into a user's external auditory canal and disposed opposite to a user's eardrum. A signal processor produces a difference signal between the output signals of two receivers exposed externally of the user's ear. The difference signal is subjected to high-pass filtering and subsequently added to the output signal of the receiver disposed inside the user's external auditory canal, thus producing a sound signal representing a user's sound. The sound signal includes a sufficient number of frequency components (e.g. frequency components higher than 3 kHz) prerequisite for discriminating the user's sound.

3 Claims, 7 Drawing Sheets

EARPHONE MICROPHONE

BACKGROUND OF THE INVENTION

1. Field of the Invention

The present invention relates to electroacoustic receivers/transmitters, and in particularly to earphones/microphones that receive and transmit sounds.

The present application claims priority on Japanese Patent Application Nos. 2010-39296 and 2010-263676, the content of which is incorporated herein by reference.

2. Description of the Related Art

Earphones/microphones (or earphone microphones) have been developed and widely used as optional devices of mobile phones (or cellular phones) allowing users to conduct hand-free conversations with counterpart ones. Earphone microphones can be designed such that miniature microphones are embedded in earpieces inserted into external auditory canals of users' ears, wherein miniature microphones receive sounds transmitted inside external auditory canals via skulls (see Patent Document 1). When earpieces are inserted into external auditory canals so as to close external auditory pores, surrounding noise occurring externally of external auditory pores are hardly transmitted into external auditory canals. Those earphone microphones are able to transmit sounds precluding surrounding noise occurring outside users' ears.

Patent Document 1: Japanese Patent Application Publication No. 2007-281916

While sounds produced by vocal cords are being transmitted to external auditory canals via skulls, specific frequency ranges prerequisite for discriminating consonants of human speeches, e.g. frequency components of 3 kHz or higher, are being canceled/attenuated. Even when talkers' sounds transmitted inside their external auditory canals are transmitted to counterpart listeners/talkers over phones, it is difficult to conduct smooth conversations due to loss of frequency components prerequisite for discriminating human speeches.

SUMMARY OF THE INVENTION

It is an object of the present invention to provide an earphone microphone incorporated in a mobile phone, which is able to precisely convert a user's speech into a sound signal including a sufficient number of frequency components prerequisite for discriminating consonants and vowels, thus achieving a smooth conversation over phones.

An earphone microphone of the present invention is constituted of a main unit and an insert portion which are unified in an L-shape. When a user attaches the earphone microphone to a user's ear, the insert portion is inserted into a user's external auditory canal (EAC). A first receiver is attached to a distal end of the insert portion and disposed opposite to a user's eardrum when the insert portion is inserted into the user's external auditory canal. A second receiver is attached to the external surface of the main unit. The second receiver is exposed and disposed externally of the user's external auditory canal into which the insert portion is inserted. A signal processor adds the output signal of the second receiver to the output signal of the first receiver so as to produce a sound signal representing a user's sound.

Preferably, the second receiver is configured of two receivers that are disposed in a plane, which perpendicularly crosses a center line of the user's external auditory canal into which the insert portion is inserted, with a predetermined distance therebetween.

In addition, the signal processor includes a subtracter that produces a difference signal between the output signals of two receivers and an adder that adds the difference signal to the output signal of the first receiver so as to produce the sound signal representing the user's sound.

Furthermore, the signal processor further includes a high-pass filter interposed between the subtracter and the adder. The high-pass filter attenuates a low frequency component in the difference signal output from the subtracter.

In the above, an external sound, which is emitted from a user's mouth so as to reach the second receiver via an external space, compensates for frequency components higher than 3 kHz which are lost while an internal sound produced by a user's vocal cord is transmitted into the user's external auditory canal via a user's skull. This makes it possible to produce a sound signal including a sufficient number of frequency components prerequisite for discriminating the user's sound. Thus, it is possible to conduct smooth conversation between persons over phones.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENTS

The present invention will be described in further detail by way of examples with reference to the accompanying drawings.

1. First Embodiment

Figure 1:
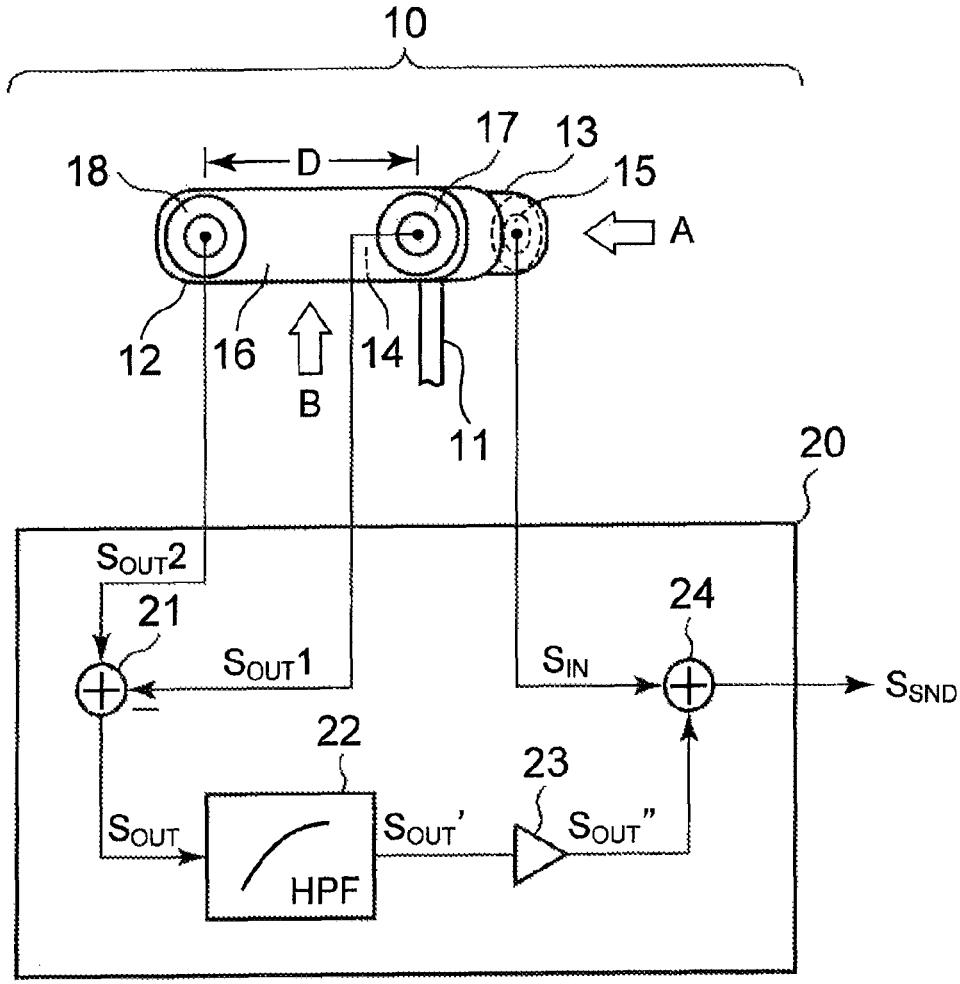
FIG. 1 shows the mechanical/electrical constitution of an earphone microphone according to a first embodiment of the present invention, wherein the earphone microphone has one internal receiver and two external receivers.
Figure 2A:
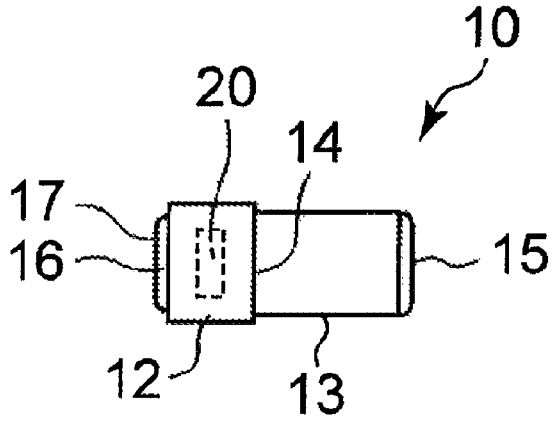
FIG. 2A is a front view of the earphone microphone observed in a direction A in FIG. 1.

FIG. 1 shows the mechanical/electrical constitution of an earphone microphone 10 according to a first embodiment of the present invention. FIG. 2A is a front view of the earphone microphone 10 observed in a direction A in FIG. 1, whilst FIG. 2B is a side view of the earphone microphone 10 observed in a direction B in FIG. 1.

The earphone microphone 10 inputs a received sound signal $S_{RCV}$ from a mobile phone (or a cellular phone, not shown) via a cable 11 so as to output (or emit) a corresponding sound into an external auditory canal of a user's ear. In addition, the earphone microphone 10 receives both of an internal sound which is produced by a vocal cord and transmitted into an external auditory canal via a skull and an external sound which is output from a mouth and transmitted into an external auditory canal via an external space. The internal sound transmitted into an external auditory canal via a skull has a frequency range lower than 3 kHz. The earphone microphone 10 generates a transmitting sound signal $S_{SND}$ such that the external sound compensates for the internal sound. The transmitting sound signal $S_{SND}$ is supplied to a mobile phone. As a means for receiving an external sound transmitted into an external auditory canal via an external space of a mouth, it is possible to present a unidirectional receiver having a single directivity of receiving sound and a bidirectional receiver having a bidirectional directivity of receiving sound. The first embodiment is designed to use a bidirectional receiver.

Figure 2B:
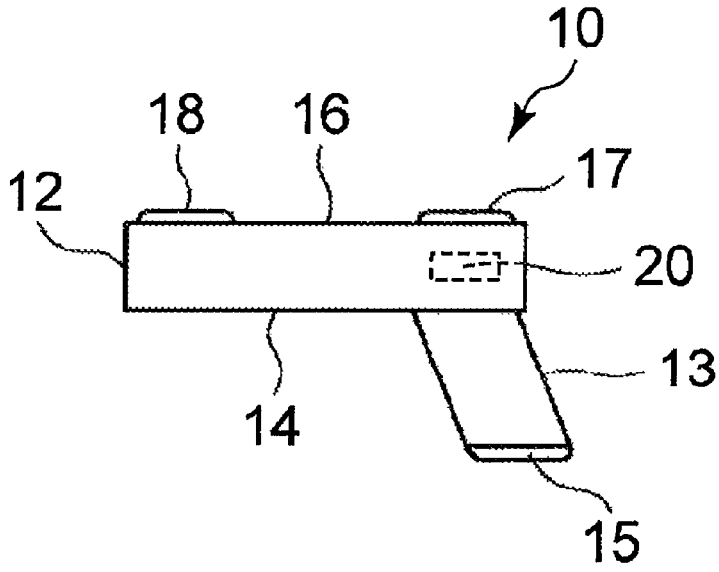
FIG. 2B is a side view of the earphone microphone observed in a direction B in FIG. 1.

An insert portion 13 is projected from an internal surface 14 of a main unit 12 of the earphone microphone 10 as shown in FIGS. 1, 2A and 2B. When the earphone microphone 10 is attached to a user's ear, the insert portion 3 is inserted into a user's external auditory canal. As shown in FIG. 2B, the insert portion 13 intersects to the internal surface 14 in an L-shaped manner, wherein an intersecting angle is an obtuse angle slightly larger than a right angle. A receiver 15 is attached to the distal end of the insert portion 13. The receiver 15 receives an internal sound which is produced by a user's vocal cord and transmitted into an external auditory canal via a skull. In addition, two receivers 17, 18 are attached to an external surface 16 of the main unit 12 (which is disposed parallel to the internal surface 14). The receivers 17, 18 receive an external sound which is emitted from a user's mouth and transmitted into an external auditory canal via an external space. Among the receivers 17, 18, the receiver 17 is positioned at the backside of the insert portion 13 on the external surface 16 of the main unit 12. Another receiver 18 is slightly distanced from the receiver 17 on the external surface 16 in an elongated direction of the main unit 12, wherein a distance D lies between the receivers 17 and 18.

Figure 3:
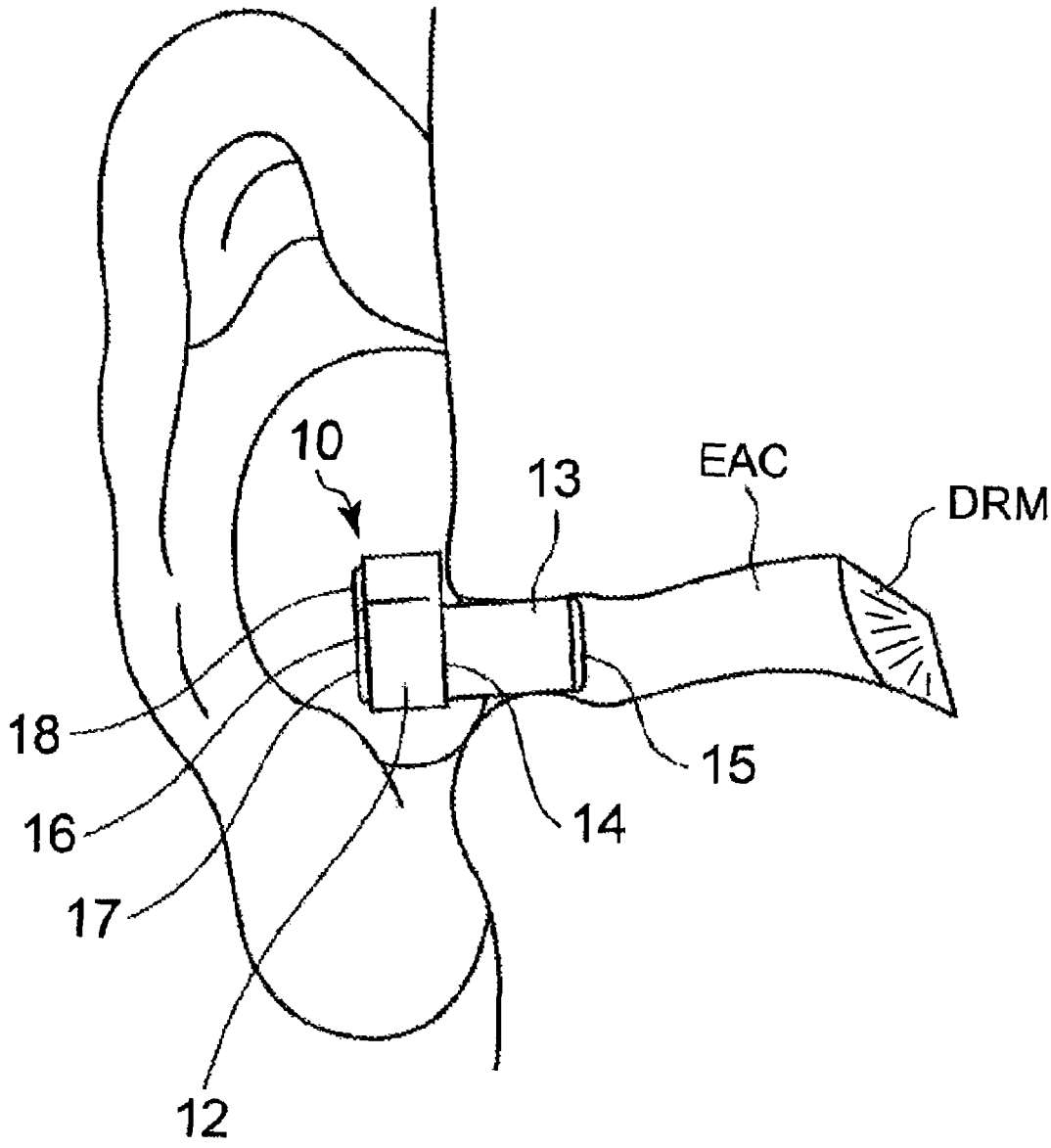
FIG. 3 shows a normal position of the earphone microphone of the first embodiment which is attached to a user's ear.

As shown in FIG. 3, a user attaches the earphone microphone 10 to his/her external ear such that the insert portion 13 projected inwardly from the internal surface 14 of the main unit 12 is inserted into a user's external auditory canal EAC. In a normal position of the earphone microphone 10 attached to a user's external ear, the receivers 17, 18 are positioned in an imaginary plane passing through a user's mouth and ears.

As described above, the earphone microphone 10 includes three receivers 15, 17 and 18. In the normal position of the earphone microphone 10, the receiver 15 attached to the distal end of the insertion portion 13 installed inside the external auditory canal EAC is positioned opposite to an eardrum DRM whilst the receivers 17, 18 are exposed outside a user's external ear. A sound S produced by a user's vocal cord is transmitted through a user's skull and the external auditory canal EAC so as to reach the receiver 15. In addition, the sound S circulates around user's cheeks and facial areas from a user's mouth so as to propagate towards the receivers 17, 18. The receivers 15, 17 and 18 receive those respective components of the sound S so as to generate sound signals $S_{IN}$, $S_{OUT}$1 and $S_{OUT}$2.

The sound signal $S_{IN}$ of the receiver 15 is attenuated in frequency components of 3 kHz or lower among all frequency components of the sound S. This is because frequency components of 3 kHz or lower are lost while the sound S is transmitted through the skull and the external auditory canal EAC. In addition, the sound signals $S_{OUT}$1, $S_{OUT}$2 of the receivers 17, 18 include noise N occurring in a user's surrounding space in addition to the sound S.

In FIG. 1, a signal processing unit 20 is configured of a digital signal processor (DSP). The signal processing unit 20 is configured of a subtracter 21, a high-pass filter (HPF) 22, an amplifier 23 and an adder 24. The subtracter 21 receives the sound signals $S_{OUT}$1, $S_{OUT}$2 output from the receivers 17, 18. The subtracter 21 subtracts the sound signal $S_{OUT}$1 of the receiver 17 from the sound signal $S_{OUT}$2 of the receiver 18, thus outputting the sound signal $S_{OUT}$. This configuration including the subtracter 21 and the receivers 17, 18 implements two functions as follows.

(a) Sound transmitted from the user's mouth is received with a higher sensitivity rather than sound transmitted in another direction.

(b) Sound is received while frequency components of 3 kHz or less are adequately attenuated.

The reason why the configuration including the subtracter 21 and the receivers 17, 18 needs to implement the functions (a), (b) will be described below.

Figure 4:
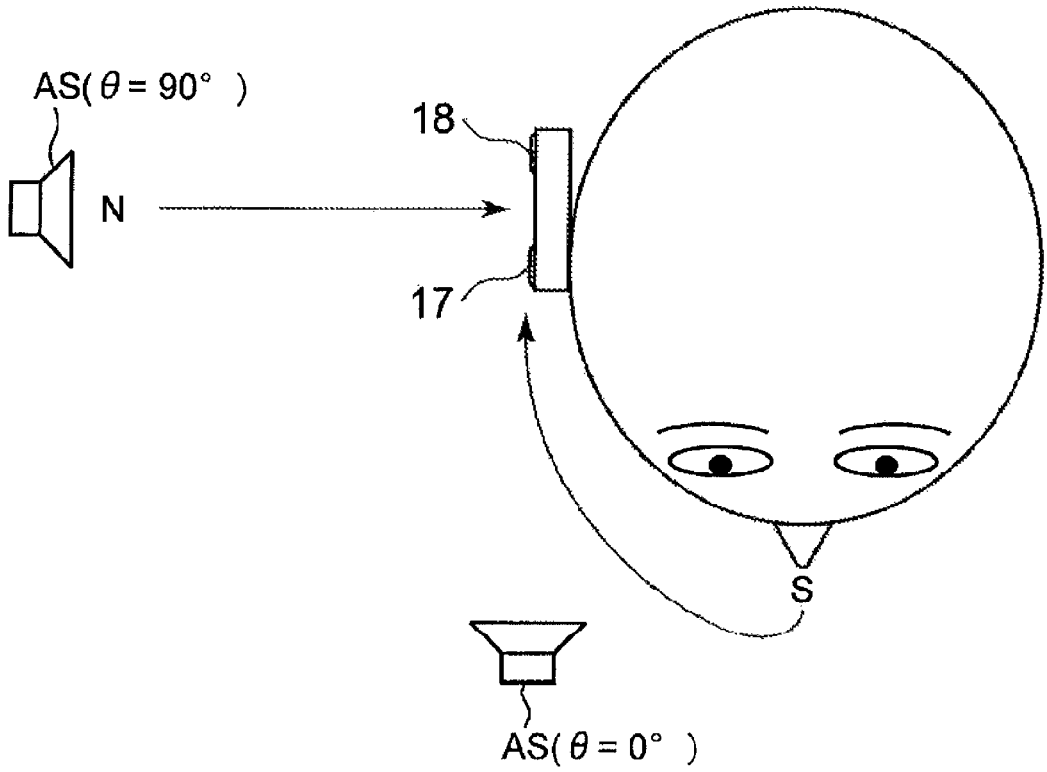
FIG. 4 is a plan view showing the positioning of a sound source in relation to the earphone microphone attached to a user's ear with an angle θ of an incoming sound/noise reaching the external receivers.

In the normal position of the earphone microphone 10 at the user's external ear, the receivers 17, 18 disposed on the external surface 16 of the main unit 12 are positioned at a front side of a user's face and a backside of a user's head respectively. FIG. 4 shows the normal position of the earphone microphone 10 in which a reference direction is set to a direction from the receiver 18 to the receiver 18 (i.e. a direction from a user's external ear to a user's face), whilst the direction of a sound source AS is set in an imaginary plane passing through a user's mouth and user's ears. Herein, an angle $\theta(0° \leq \theta 180°)$ is formed between the direction of the sound source AS and the reference direction in view of a user's ear. The sound S circulating around user's cheeks reaches the receivers 17, 18 in a direction of $\theta=0°$.

When the sound source AS is positioned in a direction of $\theta=90°$ (i.e. side direction of a user's head), a first distance in which sound propagates from the sound source AS to the receiver 17 is approximately equal to a second distance in which sound propagates from the sound source AS to the receiver 18. That is, the sound signal $S_{OUT}$1 of the receiver 17 is approximately equal to the sound signal $S_{OUT}$2 of the receiver 18 in terms of the phase and level, whereby the sound signal $S_{OUT}$ of the subtracter 21 is approximately equal to a zero level. When the direction of the sound source AS in view of a user's ear significantly deviates from the direction of $\theta=90°$, a relatively large distance difference $\Delta L$ occurs between the first distance (lying between the sound source AS and the receiver 17) and the second distance (lying between the sound source AS and the receiver 18). This causes a phase difference $\Delta\phi$ owing to the distance difference $\Delta L$ to occur between the sound signal $S_{OUT}$1 of the receiver 17 and the sound signal $S_{OUT}$2 of the receiver 18. Considering the overall frequency range of sound being received by the receivers 17, 18, the sound signal $S_{OUT}$ of the subtracter 21 is increased in level as the direction of the sound source AS in view of a user's ear deviates from the direction of $\theta=90°$ to the direction of $\theta=0°$ or the direction of $\theta=180°$. As a result, the configuration including the subtracter 21 and the receivers 17, 18 functions as a bidirectional receiver having an intense reception sensitivity with respect to a sound incoming in a front side of a user's head (where) $\theta=0°$ and a backside of a user's head (where $\theta=180°$. Specifically, the phase difference $\Delta\phi$ between the sound signals $S_{OUT}$1 and $S_{OUT}$2 depends upon the distance difference $\Delta L$ and a wavelength y of a specific frequency component selected from among frequency components included in the sound signals $S_{OUT}1$, $S_{OUT}2$. In the present embodiment, the distance D between the receivers 17 and 18 is determined to reduce the level (or the reception sensitivity) of the sound signal $S_{OUT}$ output from the configuration including the subtracter 21 and the receivers 17, 18 in the following frequency ranges.

(a) A certain level reduction in the overall frequency range (from a low frequency range to a high frequency range) of the sound signal $S_{OUT}$ which is output when the receivers 17, 18 receive a sound incoming in the direction of θ=90°.

(b) A reduction of 3 dB or more in a low frequency range lower than 3 kHz of the sound signal $S_{OUT}$ which is output when the receivers 17, 18 receive a sound incoming in the direction of θ=0° and a sound incoming in the direction of θ=180°.

Theoretically, Equation (1) is established with respect to a frequency fc (at which the reception sensitivity of a sound incoming in the direction of θ=0° and a sound incoming in the direction of θ=180° is reduced by 3 dB) and the distance D, where v denotes a sound velocity.

$$fc = \frac{v}{2D} \tag{1}$$

The present embodiments sets the distance D to D=12 mm according to Equation (1), wherein the phase difference Δϕ approaches π as the frequency of a received sound increases beyond 3 kHz, so that the sound signal $S_{OUT}$ of the subtracter 21 significantly increases in level. As a result, the level (or the reception sensitivity) of the sound signal $S_{OUT}$ output from the configuration including the subtracter 21 and the receivers 17, 18 decreases in the low frequency range lower than 3 kHz, whilst it increases in a frequency range higher than 3 kHz.

In FIG. 1, the sound signal $S_{OUT}$ of the subtracter 21 is input to the HPF 22. The HPT 22 is provided to adequately attenuate the low frequency range of the sound S when the configuration including the subtracter 21 and the receivers 17, 18 fails to adequately attenuate the low frequency range of the sound S. Upon receiving the sound signal $S_{OUT}$, the HPF 22 outputs a sound signal $S_{OUT}'$ to the amplifier 23. The amplifier 23 amplifies the sound signal $S_{OUT}'$ so as to output an amplified sound signal $S_{OUT}''$ having a preferable level subjected to transmission between mobile phones conducting conversation. The adder 24 adds the sound signal $S_{IN}$ of the receiver 15 and the sound signal $S_{OUT}''$ of the amplifier 23 so as to produce the transmitting sound signal $S_{SND}$. The transmitting sound signal SSND is supplied to a mobile phone via the cable 11 and transmitted to a counterpart mobile phone.

As described above, the present embodiment is designed to attach the receiver 15 to the distal end of the insert portion 13 which is inserted into the user's external auditory canal EAC. In addition, the present embodiment arranges the two receivers 17, 18 which are positioned in the front side of a user's face and the backside of a user's head externally of a user's ear in the normal position of the earphone microphone 10. The signal processing unit 20 produces the transmitting sound signal $S_{SND}$ such that the sound signal $S_{OUT}$ (representing the difference between the sound signals $S_{OUT}1$ and $S_{OUT}2$ output from the receivers 17 and 18) compensates for low frequency components lower than 3 kHz, which are precluded from the sound signal $S_{IN}$ of the receiver 15. Thus, it is possible to send the transmitting sound signal $S_{SND}$ including a sufficient number of frequency components prerequisite for precisely discriminating the sound S (particularly, consonants of the sound S) to a counterpart listener/talker.

In order to confirm the effect of the present embodiment, the inventor has performed measurement on two samples, i.e. an earphone microphone 10-D12 (in which the distance D between the receivers 17 and 18 are set to D=12 mm) and an earphone microphone 10-singl which is equipped with a single receiver (i.e. the receiver 17 out of the receivers 17, 18). First, the inventor has measured a sound signal $S_{OUT}''$-D12 which is output from the amplifier 23 of the earphone microphone 10-D12 when the receivers 17, 18 receive a sound emitted from the sound source AS in the direction of θ=0° and a sound signal $S_{OUT}''$-singl which is output from the amplifier 23 of the earphone microphone 10-singl when the receiver 17 receives a sound emitted from the sound source AS in the direction of θ=0°. Subsequently, the inventor has calculated the ratio (dB) of the sound signal $S_{OUT}''$-D12 to the sound signal $S_{OUT}''$-singl with respect to 500 Hz, 1000 Hz, 2000 Hz, 4000 Hz and 8000 Hz (see a first row in Table 1). In addition, the inventor has measured a sound signal $S_{OUT}'$-D12 which is output from the amplifier 23 of the earphone microphone 10-D12 when the receivers 17, 18 receive a sound emitted from the sound source AS in the direction of θ=90° and a sound signal $S_{OUT}''$-singl which is output from the amplifier 23 of the earphone microphone 10-singl when the receiver 17 receives a sound emitted from the sound source AS in the direction of θ=90°. Subsequently, the inventor has calculated the ratio (dB) of the sound signal $S_{OUT}''$-D12 to the sound signal $S_{OUT}''$-singl with respect to 500 Hz, 1000 Hz, 2000 Hz, 4000 Hz and 8000 Hz (see a second row in Table 1).

TABLE 1

| Frequency (Hz) | 500 | 1000 | 2000 | 4000 | 8000 |
|---|---|---|---|---|---|
| 0° | −21.6 | −18.6 | −11.7 | −13.3 | −2.0 |
| 90° | −25.6 | −29.8 | −26.5 | −30.3 | −27.9 |

Table 1 shows that the earphone microphone 10-D12 having the distance of D=12 mm between the receivers 17 and 18 undergoes a 20 dB or more attenuation of the incoming sound of θ=90° in the overall frequency range from 500 Hz to 8000 Hz. In contrast, the earphone microphone 10-D12 undergoes an approximately 20 dB attenuation of the incoming sound of θ=0° in a frequency range from 500 Hz to 1000 Hz, whilst it undergoes a 15 dB or less attenuation of the incoming sound of θ=0° in a frequency range higher than 2000 Hz.

Figure 5:
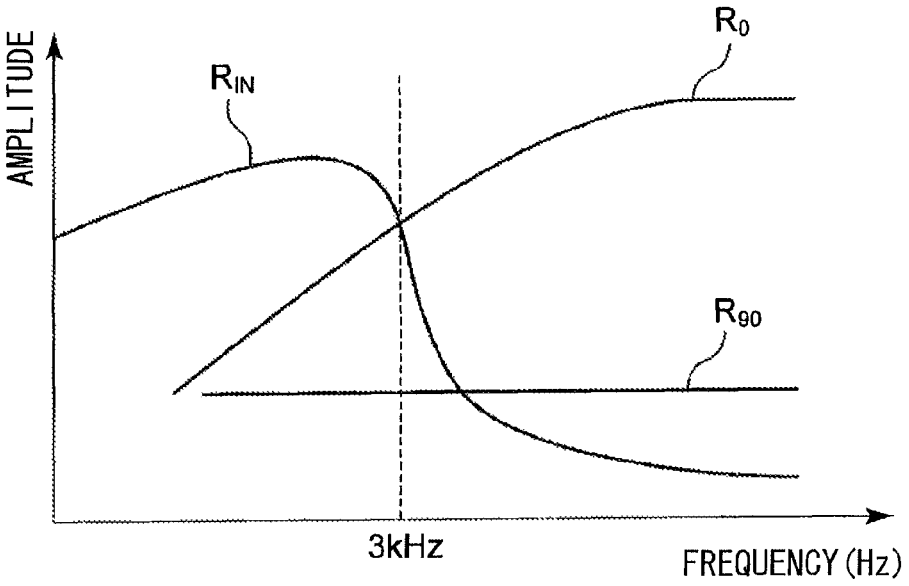
FIG. 5 is a graph showing an amplitude characteristic $R_{IN}$ representing an internal sound reaching the internal receiver installed in a user's external auditory canal from a user's vocal cord, an amplitude characteristic $R_0$ representing an incoming sound of $\theta=0°$ reaching the external receivers, and an amplitude characteristic $R_{90}$ representing an incoming sound of $\theta=90°$ reaching the external receivers.

FIG. 5 shows three amplitude characteristics with respect to the earphone microphone 10-D12 having the distance of D=12 mm between the receivers 17 and 18, wherein RIN denotes an amplitude characteristic of an internal sound transmitted along an internal transmission path from the user's vocal cord to the receiver 15 via the user's external auditory canal EAC, R0 denotes an amplitude characteristic of an incoming sound of θ=0° transmitted along an external transmission path from the receivers 17, 18 to the amplifier 23, and R90 denotes an amplitude characteristic of an incoming sound of θ=90° transmitted along the external transmission path. Herein, the amplitude characteristic R0 decreases in a frequency range lower than 3 kHz, whilst the amplitude characteristic R90 decreases in the overall frequency range (from a low frequency to a high frequency). Although the amplitude characteristic RIN decreases in a frequency range higher than 3 kHz, the incoming sound of θ=0° (i.e. the user's sound S) compensates for such a reduction of amplitude in frequency components higher than 3 kHz.

2. Second Embodiment

Figure 6:
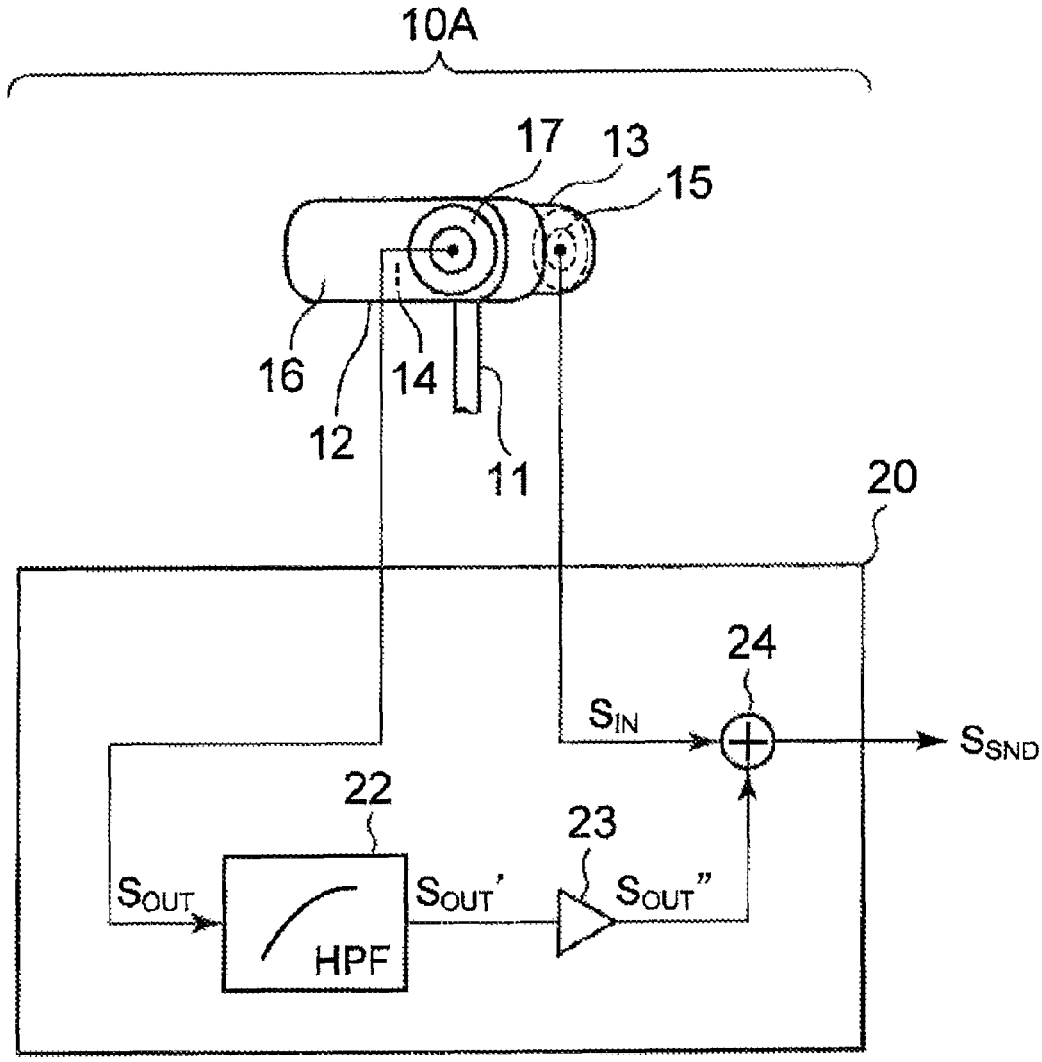
FIG. 6 shows the mechanical/electrical constitution of an earphone microphone according to a second embodiment of the present invention.

FIG. 6 shows the mechanical/electrical constitution of an earphone microphone 10A according to a second embodiment of the present invention, wherein parts identical to those shown in FIG. 1 are designated by the same reference numerals. Compared to the earphone microphone 10 of the first embodiment in which two receivers 17, 18 are disposed on the external surface 16 of the main unit 12, the earphone microphone 10A of the second embodiment is equipped with one receiver 17 which is configured of a unidirectional microphone disposed on the external surface 16 of the main unit 12. In the earphone microphone 10A, the receiver 17 receives an external sound so as to generate a sound signal $S_{OUT}$, which is supplied to the HPF 22. The HPF 22 attenuates low frequency components lower than 3 kHz in the sound signal $S_{OUT}$, thus producing a sound signal $S_{OUT}'$ including frequency components higher than 3 kHz. The sound signal $S_{OUT}'$ is amplified in the amplifier 23, which thus outputs an amplified sound signal $S_{OUT}''$. The sound signal $S_{OUT}'$ includes frequency components higher than 3 kHz, which are useful to linguistically comprehend the user's sound S. The "linguistically comprehensive" sound signal $S_{OUT}'$ is amplified and added to the sound signal $S_{IN}$ representing an internal sound received by the receiver 15. The adder 24 adds the sound signals $S_{OUT}$ and $S_{IN}$ so as to produce a sound signal $S_{SND}$. Thus, the earphone microphone 10A is able to send the sound signal $S_{SND}$, in which frequency components higher than 3 kHz useful for comprehension of the user's sound S are added to the internal sound received by the receiver 15, to the counterpart listener/talker over phones.

The second embodiment is characterized in that one receiver 17 disposed on the external surface 16 of the main unit 12 receives the sound S so as to produce the sound signal $S_{OUT}$, which is subjected to filtering by the HPF 22. The filtered sound signal $S_{OUT}'$ includes frequency components which are lost while the sound S passes through the user's skull and the external auditory canal EAC. In addition, the earphone microphone 10A of the second embodiment can be reduced in size compared to the earphone microphone 10 by reducing the size of the main unit 12.

3. Variations

The present invention is not necessarily limited to the first and second embodiments, which can be further modified in various ways.

Figure 7:
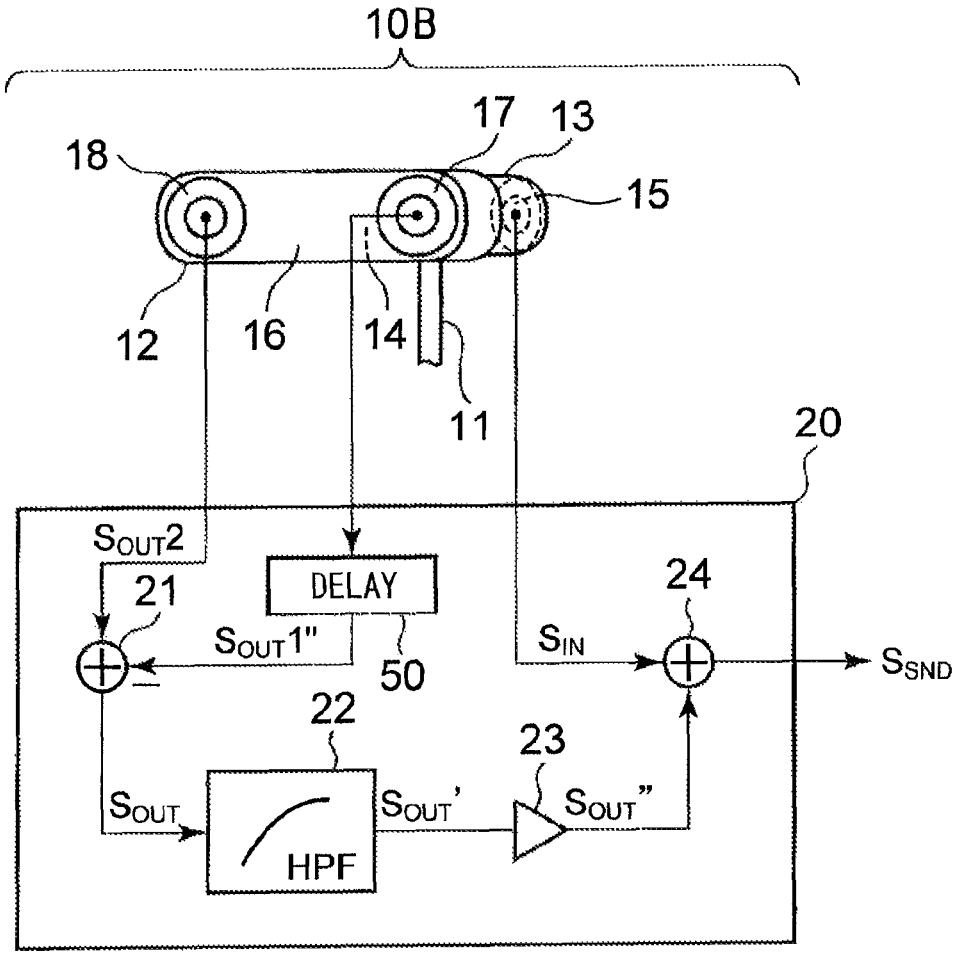
FIG. 7 shows the mechanical/electrical constitution of an earphone microphone according to a variation of the first embodiment of the present invention.

(1) It is possible to modify the earphone microphone 10 of the first embodiment into an earphone microphone 10B shown in FIG. 7, in which a delay unit 50 is interposed between at least one of the receivers 17, 18 on the external surface 16 (e.g. the receiver 17) and the subtracter 21. In the earphone microphone 10B, the delay unit 50 delays the sound signal $S_{OUT}1$ of the receiver 17 so as to output a delayed sound signal $S_{OUT}1''$, which is supplied to the subtracter 21. The subtracter 21 subtracts the delayed sound signal $S_{OUT}1''$ from the sound signal $S_{OUT}2$ of the receiver 18, thus outputting a sound signal $S_{OUT}$. This variation is advantageous in that the configuration including the subtracter 21 and the receivers 17, 18 is able to set a desired frequency as the upper-limit frequency of a frequency range lower than the reception sensitivity.

(2) The number of receivers disposed on the external surface 16 of the main unit 12 is not necessarily limited to one or two. It is possible to arrange three or more receivers on the external surface 16 of the main unit 12 of the earphone microphone 10.

(3) It is possible to modify the earphone microphone 10 such that the receivers 17, 18 are replaced with directional microphones achieving a high directivity towards a user's mouth.

(4) It is possible to modify the earphone microphones 10 and 10A such that the HPT 22 and the amplifier 23 are unified as a single circuitry.

(5) It is possible to modify the earphone microphone 10 such that the subtracter 21 is replaced with an adder. The configuration including the adder and the receivers 17, 18 is designed to enhance the reception sensitivity with respect to a desired frequency range of sound.

(6) It is possible to modify the earphone microphone 10A such that a directional microphone achieving a high directivity toward a user's mouth is adopted as the receiver 17 on the external surface 16 of the main unit 12. In this case, the frequency characteristic of the directional microphone is adjusted such that the sound signal $S_{OUT}$ of the receiver 17 can be directly supplied to the amplifier 23 without using the HPF 22 which is unnecessarily interposed between the receiver 17 and the amplifier 23.

Lastly, the present invention is not necessarily limited to the embodiments and variations, which can be further modified within the scope of the invention defined by the appended claims.

What is claimed is:

1. An earphone microphone comprising:

an insert portion that is inserted into a user's ear;

a first receiver attached to a distal end of the insert portion, wherein the first receiver is disposed opposite to a user's eardrum when the insert portion is inserted into a user's external auditory canal;

a pair of second receivers attached to an external surface that is exposed and disposed externally of the user's external auditory canal into which the insert portion is inserted; and a signal processor including a subtracter configured to produce a difference signal between output signals of the pair of second receivers and an adder configured to add the difference signal to an output signal of the first receiver so as to produce a sound signal representing a user's sound.

2. The earphone microphone according to claim 1, wherein the signal processor further includes a high-pass filter interposed between the subtracter and the adder, wherein the high-pass filter attenuates a low frequency component in the difference signal output from the subtracter.

3. The earphone microphone according to claim 1, wherein the pair of second receivers are disposed in a plane, which perpendicularly crosses a center line of the user's external auditory canal into which the insert portion is inserted, with a predetermined distance therebetween.

* * * * *